US007172073B2

(12) United States Patent
Hanson

(10) Patent No.: US 7,172,073 B2
(45) Date of Patent: Feb. 6, 2007

(54) SYSTEM AND METHOD TO COMMUNICATE ABSORBENT PRODUCT FEATURES TO CONSUMERS

(75) Inventor: Kim Ann Hanson, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 253 days.

(21) Appl. No.: 10/728,394

(22) Filed: Dec. 5, 2003

(65) Prior Publication Data

US 2005/0121347 A1 Jun. 9, 2005

(51) Int. Cl.
*B65D 23/12* (2006.01)
*B65D 73/00* (2006.01)

(52) U.S. Cl. ..... 206/733; 206/440; 206/459.1; 206/459.5; 206/494

(58) Field of Classification Search ..... 206/440, 206/441, 459.1, 459.5, 494, 730, 732–735, 206/278, 457; 604/358, 385.02, 385.19
See application file for complete search history.

(56) References Cited

U.S. PATENT DOCUMENTS

| | | | | |
|---|---|---|---|---|
| 1,103,880 | A * | 7/1914 | Johnson | 206/730 |
| 1,667,320 | A * | 4/1928 | Kinsey | 206/494 |
| 2,037,143 | A * | 4/1936 | Nutt | 206/733 |
| 2,322,057 | A * | 6/1943 | Poutinen | 206/730 |
| 3,354,576 | A * | 11/1967 | Gralnick | 206/278 |
| 5,865,013 | A * | 2/1999 | Jackson | 206/278 |
| 6,095,326 | A * | 8/2000 | Madhat et al. | 206/494 |
| 6,688,466 | B2 * | 2/2004 | White et al. | 206/440 |
| 2001/0035368 | A1 * | 11/2001 | Carr | 206/730 |
| 2003/0102238 | A1 | 6/2003 | Us | |

FOREIGN PATENT DOCUMENTS

| | | | |
|---|---|---|---|
| EP | 0326798 | B1 | 7/1994 |
| EP | 1321918 | A2 | 6/2003 |
| EP | 1357532 | A | 10/2003 |
| FR | 2329544 | A | 5/1977 |
| GB | 1499146 | A | 1/1978 |
| JP | 02000093455 | A * | 4/2000 |

OTHER PUBLICATIONS

English Language Abstract for Patent No. EP 0 326 798 B1 from ep.espacenet.com.

* cited by examiner

*Primary Examiner*—Luan K. Bui
(74) *Attorney, Agent, or Firm*—Dority & Manning, P.A.

(57) ABSTRACT

The present invention discloses and claims a packaging system and method for communicating absorbent product features to consumers. The packaging system includes a container and a consumer message label attached to the container. The consumer message label includes one or more swatches of the absorbent product, a future product, a related product, or a competitor's product for direct sensory perception by consumers without opening the container.

19 Claims, 3 Drawing Sheets

SYSTEM AND METHOD TO COMMUNICATE ABSORBENT PRODUCT FEATURES TO CONSUMERS

BACKGROUND OF THE INVENTION

The present invention relates to packaging of absorbent products and methods of communicating absorbent product features to customers.

A broad range of absorbent products exists in the art. Examples of commonly available absorbent products include adult care products such as incontinence pads; child care products such as diapers and training pants; feminine care products such as sanitary pads, panty liners, inter-labial absorbent articles, and tampons; and other absorbent products such as bathroom tissue, paper towels, hand wipes, face wipes, perineal wipes, facial tissue, wound care dressings, and bandages. These products are commonly available for retail sale through grocery stores, convenience stores, supermarkets, and other retail outlets.

Each absorbent product may include various combinations of qualities, features, and/or characteristics designed to improve the performance, comfort, quality, and/or appearance of the product. By their nature, absorbent products are personal and private items, and consumers often have strong purchase preferences for the various qualities, features, and/or characteristics available in the absorbent products.

Manufacturers continually develop, refine, and improve the qualities, features, and/or characteristics of absorbent products. Manufacturers package absorbent products in sealed containers, such as boxes, bags, or wrappers, to ensure cleanliness and sanitation. Typically, the container holds multiple absorbent products having identical qualities, features, and/or characteristics. The product packaging generally includes a description of the particular absorbent product; however, the product packaging necessarily prevents the consumer from directly sensing the various qualities, features, and/or characteristics of the product prior to purchase.

As a result, consumers must select and purchase a particular product based solely on the product promotion and description present on the packaging without the ability to directly touch, see, and inspect the product. Consumers who cannot read, are in too much of a hurry to read, have poor vision, or otherwise forego reading the description on the product packaging may select and purchase a particular product without directly touching or inspecting the product. This may result in embarrassment, distress, confusion, or mistakes in selecting a particular absorbent product for purchase and use. Therefore, the need exists for an improved packaging system and method to communicate the qualities, features, and/or characteristics of absorbent products to consumers prior to purchase.

SUMMARY OF THE INVENTION

Objects and advantages of the invention are set forth below in the following description, or may be obvious from the description, or may be learned through practice of the invention.

In one embodiment of the invention, a packaging system for absorbent products includes an absorbent product, a container enclosing the absorbent product, and a consumer message label attached to the container. The consumer message label includes a swatch containing a predetermined feature that is available for direct sensory touch by the consumer without opening the container. The consumer product label may optionally include a backing surface and/or a cover having an aperture through which the swatch is directly available, by touch and/or sight, to the consumer. In a particular embodiment, the absorbent product in the container is a feminine care product. In other embodiments, the container and/or the consumer message label may include advertising, printed or embossed, of the predetermined product feature. Optionally, the consumer message label may be removable from the container without damaging the container.

The invention also encompasses an improved method for communicating an absorbent product feature to a consumer. This method includes selecting a first absorbent product feature for communication to the consumer, enclosing an absorbent product in a container, creating a consumer message label, and obtaining and attaching a sample containing the absorbent product feature to the consumer message label. Using this method, the consumer can directly contact the sample containing the absorbent product feature without opening the container. This method may also include advertising the absorbent product feature on the consumer message label. Furthermore, the method may permit replacing the consumer message label with a different consumer message label bearing a different absorbent product feature for communication to the consumer.

Those of ordinary skill in the art will better appreciate the features and aspects of such embodiments, and others, upon review of the specification.

BRIEF DESCRIPTION OF THE FIGURES

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
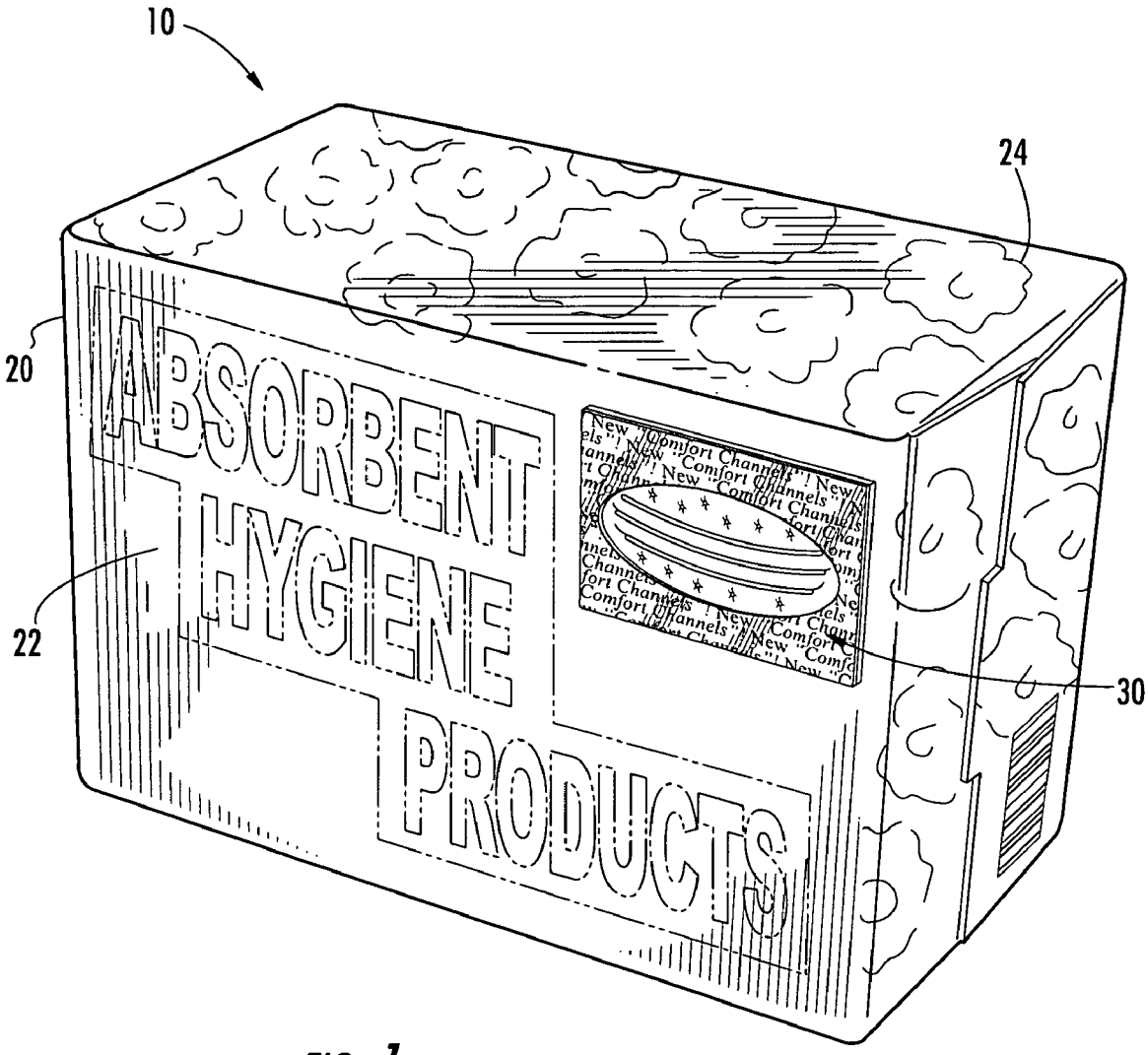
FIG. 1 is a perspective view of an embodiment of the present invention.
Figure 2:
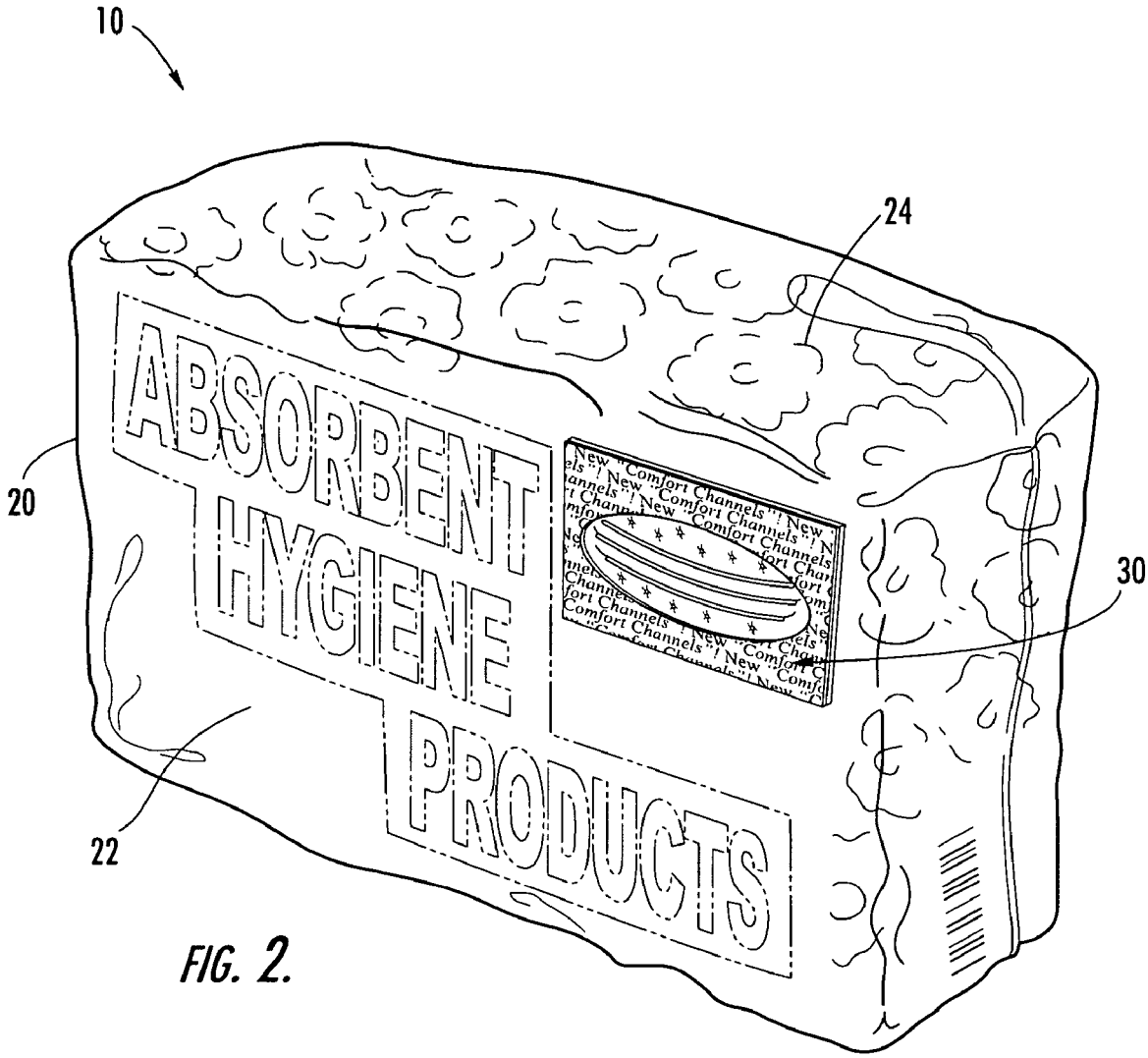
FIG. 2 is a perspective view of an alternate embodiment of the present invention.

FIGS. 1 and 2 illustrate a packaging system 10 according to an embodiment of the present invention. The packaging system 10 communicates a predetermined quality, feature, and/or characteristic of an absorbent product to consumers prior to purchase. The predetermined quality, feature, and/or characteristic may exist in the absorbent product contained therein, may exist in a related absorbent product, or may be planned for a future absorbent product.

The packaging system 10 generally includes a container 20 and a consumer message label 30.

The container 20 is configured for receipt of one or more absorbent products therein. The container 20 may take on any manner of conventional package, such as the box illustrated in FIG. 1 or a soft-side package or bag illustrated in FIG. 2. These types of containers are well known and used in the industry, and a detailed description thereof is not necessary for purposes of understanding the present invention.

The container 20 includes an external surface 22. The external surface 22 may include product information, advertisement, and/or promotional language. The product information, advertisement, and/or promotional language may pertain to the absorbent product contained therein, a related absorbent product, a future absorbent product, or a competitor's product, by way of comparison and contrast. Alternately, the external surface 22 may simply include a nondescript, aesthetic configuration over at least a substantial portion thereof that does not advertise or otherwise give an indication of the absorbent products within the container 20. For example, in the embodiment illustrated in FIGS. 1 and 2, the nondescript surface configuration is a floral pattern 24. It should be appreciated that any combination of patterns, colors, etc. may be utilized in this regard to provide a generally pleasing and nondescript surface configuration for the container 20.

Figure 3:
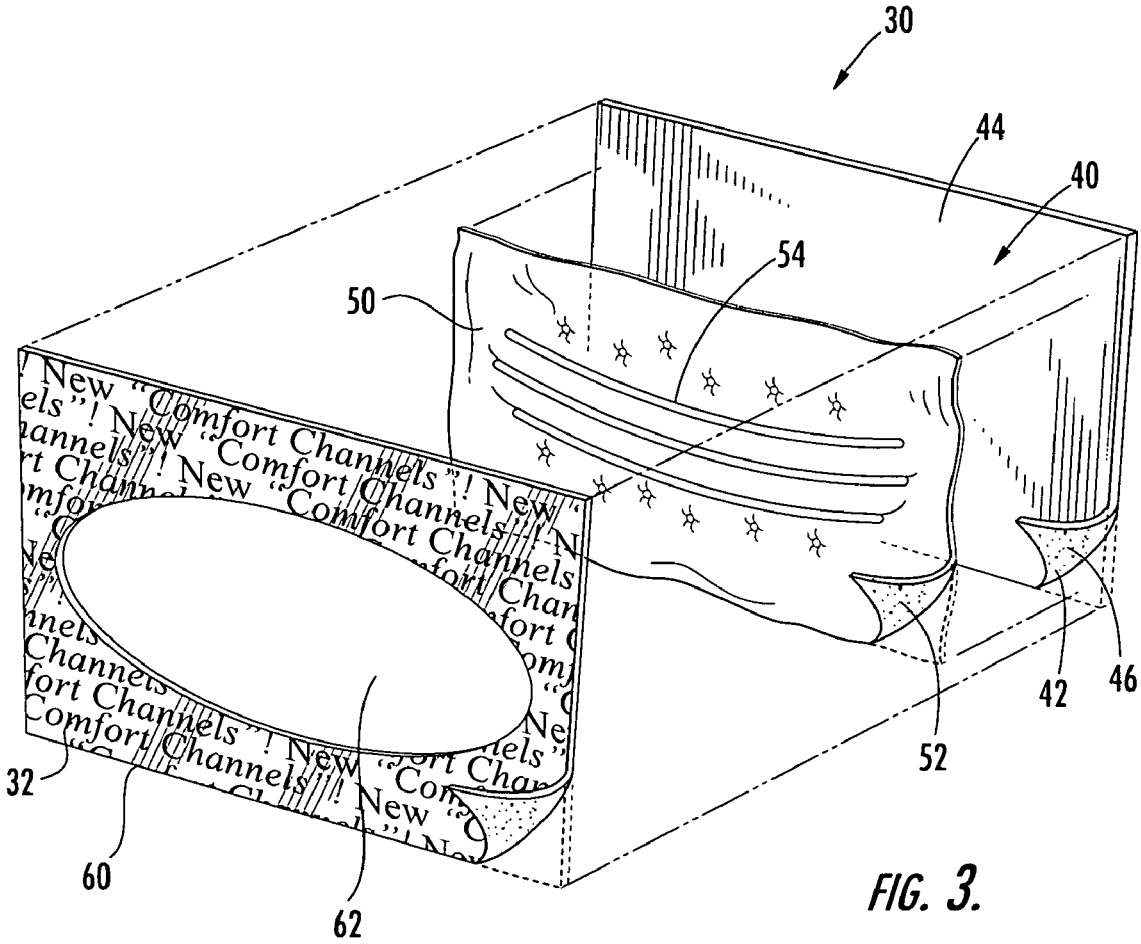
FIG. 3 is an exploded perspective view of a portion of the embodiment depicted in FIGS. 1 and 2.

FIG. 3 illustrates an embodiment of the consumer message label 30 within the scope of a particular embodiment of the present invention. As shown, the consumer message label 30 includes a backing surface 40, a swatch 50, and a cover 60. It should be understood by one of ordinary skill in the art that alternate embodiments of the consumer message label 30 within the scope of the present invention may include other combinations of the backing surface 40, swatch 50, and cover 60. For example, in an alternate embodiment, the consumer message label 30 may include only the swatch 50 directly mounted to the external surface 22 of the container 20 without including either a backing surface 40 or a cover 60. Alternately, the consumer message label 30 may include the swatch 50 with either a backing surface 40 or a cover 60. In yet another embodiment, the consumer message label 30 may include a plurality of swatches 50, each depicting a predetermined quality, feature, and/or characteristic of the absorbent product, a future product, a related product, or a competitor's product.

The consumer message label 30 attaches to any portion of the container 20 and typically occupies a fraction of the area of the external surface 22 to minimize obstruction of any product information, advertisement, promotional language, or aesthetic configuration contained thereon. For example, the consumer message label 30 may attach to the external surface 22 adjacent to product information, advertisement, and/or promotional language directed to the predetermined quality, feature, and/or characteristic being communicated by the package system 10. Any portion of the consumer message label 30 may also include product information, advertisement, and/or promotional language to complement, contrast, or otherwise supplement information that may be present on the external surface 22 of the container 20.

The backing surface 40 is an optional component of the consumer message label 30 the provides an interface between the consumer message label 30 and the container 20. The backing surface 40 includes a product side 42 and a consumer side 44. The backing surface 40 generally comprises a thin, flexible material made from paper, poly film, or similarly suitable substitute. As such, the backing surface 40 readily conforms to the shape of the external surface 22 of the container 20.

The product side 42 of the backing surface 40 faces the container 20 and includes a means for attaching 46 the consumer message label 30 to the external surface 22 of the container 20. The means for attachment 46 may include adhesive, hooks-and-loops, glue, fasteners, staples, bonding agents, or other equivalent materials readily available and known to one of ordinary skill in the art. The means for attachment 46 may be temporary to allow the consumer to remove the consumer message label 30 from the container 20 prior to or after purchase without damaging or compromising the container 20. Alternately, the means for attachment 46 may be re-usable to allow the manufacturer to selectively substitute consumer message labels containing different qualities, features, and/or characteristics, depending on consumer response and product promotions.

The consumer side 44 of the backing surface 40 faces away from the container 20 and provides a mounting surface for the swatch 50.

The swatch 50 includes the predetermined quality, feature, and/or characteristic 54 of the absorbent product, a future product, a related product, or a competitor's product for communication to the consumer. The swatch 50 may include a sample of the absorbent product, or the swatch 50 may include a substitute material that possesses the same predetermined quality, feature, and/or characteristic 54 sought to be communicated to the consumer. For example, by way of illustration only and without limiting the scope of the present invention, the swatch 50 may include a portion of a sanitary napkin to provide the consumer an opportunity to directly perceive, inspect, and/or evaluate the texture, thickness, color, shape, construction, appearance, flexibility, abrasiveness, moisture, softness, durability, and/or other predetermined quality, feature, and/or characteristic of the feminine care product. A particular embodiment may also include multiple swatches 50 in the consumer message label 30, with each swatch 50 possessing a particular quality, feature, and/or characteristic 54 of the absorbent product, a future product, a related product, or a competitor's product for comparison by the consumer.

Depending on the particular embodiment, the swatch 50 attaches to the backing surface 40 (if used) or directly to the external surface 22 of the container 20. The swatch 50 may include a means for attaching 52 to the consumer side 44 of the backing surface 40 (if used) or directly to the external surface 22 of the container 20. The means for attachment 52 may include adhesive, hooks-and-loops, glue, fasteners, staples, bonding agents, or other equivalent materials readily available and known to one of ordinary skill in the art. The swatch 50 may attach flush with the backing surface 40 or external surface 22. Alternately, the swatch 50 may be hinged, creased, folded, or similarly configured so that attachment to the backing surface 40 or external surface 22 presents multiple surfaces of the swatch 50 for sensory perception by the consumer.

The cover 60 is an optional component of the consumer message label 30 that provides additional structure and/or integrity to the consumer message label 30. The cover 60 attaches to the swatch 50 and/or the backing surface 40 and/or the external surface 22 of the container 20, depending on the particular embodiment. The cover 60 generally comprises a thin, flexible material made from paper, poly film, or similarly suitable substitute. The cover 60 may be die cut and includes an aperture 62 through which the swatch 50 is directly available to the consumer, both tactilely and visually.

As shown in FIGS. 1, 2, and 3, the consumer message label 30 may optionally include product information, advertisement, and/or promotional language 32 regarding the predetermined quality, feature, and/or characteristic of the absorbent product, a future product, a related product, or a competitor's product for communication to the consumer. The product information, advertisement, and/or promotional language 32 on the consumer message label 30 is not limited to the predetermined quality, feature, and/or characteristic of the absorbent product and may include reference to related advertisement or promotion communicated to the consumer through alternate media, such as circulars, magazines, newspapers, radio, and television. This product information, advertisement, and/or promotional language 32 may be embossed or printed on the cover 60, as shown in FIG. 3. Alternately, the product information, advertisement, and/or promotional language 32 may be printed on the swatch 50 and/or the consumer side 44 of the backing surface 40.

As described above and illustrated in FIGS. 1 and 2, the consumer message label 30 initially draws attention to the package system 10. In this manner, the consumer message label 30 may communicate to the consumer qualities, features, and/or characteristics of the present absorbent product, future absorbent products, or even related absorbent products. Specifically, the swatch 50 and optional product information, advertisement, or promotional language 32 communicate the predetermined quality, feature, and/or characteristic of the absorbent product to the consumer. In this configuration, the consumer message label 30 allows consumers to directly perceive, inspect, and/or evaluate the predetermined quality, feature, and/or characteristic of the absorbent product prior to purchase. Conversely, the consumer message label 30 allows the manufacturer to direct the consumer's attention to particular qualities, features, and/or characteristics of the absorbent product without having to change or redesign the container 20.

It should be appreciated by those skilled in the art that modifications and variations can be made to the embodiments of the invention set forth herein without departing from the scope and spirit of the invention as set forth in the appended claims and their equivalents.

What is claimed:

1. A packaging system for absorbent products, said packaging system comprising:

a. an absorbent product;

b. a container enclosing said absorbent product, said container including an external surface;

c. a consumer message label attached to said external surface of said container, said consumer message label including a first swatch, wherein said first swatch includes a first predetermined feature and is available for direct sensory touch without opening said container; and d. a cover adjacent to said first swatch, said cover having an aperture through which said first swatch is available for direct sensory touch without opening said container.

2. The packaging system as in claim 1, wherein said absorbent product in said container is a feminine care product.

3. The packaging system as in claim 1, wherein said absorbent product in said container includes said first predetermined feature.

4. The packaging system as in claim 3, wherein said first swatch comprises at least a portion of said absorbent product having said first predetermined feature.

5. The packaging system as in claim 1, wherein said external surface of said container includes advertising of said absorbent product.

6. The packaging system as in claim 5, wherein said consumer message label is attached to said external surface adjacent to said advertising of said absorbent product.

7. The packaging system as in claim 1, wherein said consumer message label further includes a backing surface attached to said external surface of said container.

8. The packaging system as in claim 1, wherein said consumer message label further includes a second swatch, wherein said second swatch includes a second predetermined feature and is available for direct sensory touch without opening said container.

9. The packaging system as in claim 1, wherein said consumer message label is removable from said external surface of said container without damaging said container.

10. The packaging system as in claim 1, wherein said consumer message label further includes advertising of said predetermined feature.

11. The packaging system as in claim 10, wherein said advertising of said predetermined feature is printed on said consumer message label.

12. The packaging system as in claim 10, wherein said advertising of said predetermined feature is embossed on said consumer message label.

13. The packaging system as in claim 1, wherein said consumer message label substantially conforms to said external surface of said container.

14. The packaging system as in claim 1, wherein said first swatch is available for direct visual perception without opening said container.

15. A packaging system for absorbent products, said packaging system comprising:

a. an absorbent product;

b. a container enclosing said absorbent product, said container including an external surface;

c. a consumer message label attached to said external surface of said container, said consumer message label including a first swatch and a second swatch, wherein i. said first swatch includes a first predetermined feature;

ii. said second swatch includes a second predetermined feature;

iii. said first and second predetermined features are not identical;

iv. said first and second swatches are available for direct sensory touch without opening said container d. wherein said consumer message label further includes a cover adjacent to said first swatch, said cover having an aperture through which said first swatch is available for direct sensory touch without opening said container.

16. The packaging system as in claim 15, wherein said consumer message label further includes a backing surface attached to said external surface of said container.

17. The packaging system as in claim 15, wherein said consumer message label is removable from said external surface of said container without damaging said container.

18. The packaging system as in claim 15, wherein said absorbent product in said container includes said first predetermined feature.

19. The packaging system as in claim 15, wherein said absorbent product in said container includes said first and second predetermined features.

* * * * *